US011476032B2

(12) United States Patent
Yamamoto et al.

(10) Patent No.: US 11,476,032 B2
(45) Date of Patent: Oct. 18, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Shinichiro Yamamoto, Mie (JP); Tatsuo Hirabayashi, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 518 days.

(21) Appl. No.: 16/614,583

(22) PCT Filed: May 8, 2018

(86) PCT No.: PCT/JP2018/017763

§ 371 (c)(1),
(2) Date: Nov. 18, 2019

(87) PCT Pub. No.: WO2018/221128

PCT Pub. Date: Dec. 6, 2018

(65) Prior Publication Data

US 2020/0176171 A1 Jun. 4, 2020

(30) Foreign Application Priority Data

May 29, 2017 (JP) ..... JP2017-106035

(51) Int. Cl.
*H01F 27/24* (2006.01)
*H01F 27/28* (2006.01)
(Continued)

(52) U.S. Cl.
CPC ..... *H01F 27/24* (2013.01); *H01F 27/2823* (2013.01); *H01F 27/306* (2013.01); *H01F 27/327* (2013.01)

(58) Field of Classification Search
CPC .... H01F 27/24; H01F 27/2823; H01F 27/306; H01F 27/327; H01F 37/00
(Continued)

(56) References Cited

U.S. PATENT DOCUMENTS 8,717,133 B2 * 5/2014 Ooishi ..... H01F 27/22 336/60
10,192,670 B2 * 1/2019 Nishi ..... H01F 27/2823
(Continued)

OTHER PUBLICATIONS

International Search Report, Application No. PCT/JP2018/017763, dated Aug. 7, 2018. ISA/Japan Patent Office.

*Primary Examiner* — M Baye Diao
(74) *Attorney, Agent, or Firm* — Honigman LLP

(57) ABSTRACT

A reactor including: a coil that includes a winding portion; a magnetic core that includes an inner core portion that is disposed inside the winding portion and an outer core portion that is disposed outside the winding portion; and an outer interposed portion that is interposed between an end surface of the winding portion and an inner end surface of the outer core portion The winding portion includes a winding wire body and a fusing layer that is provided on an outer circumferential surface of the winding wire body and joins turns that are adjacent to each other, and the reactor further includes an adhesion prevention structure configured to prevent the end surface of the winding portion and the outer interposed portion from adhering to each other due to the fusing layer.

6 Claims, 3 Drawing Sheets

(51) Int. Cl.
*H01F 27/32* (2006.01)
*H01F 27/30* (2006.01)

(58) Field of Classification Search
USPC ..... 336/221
See application file for complete search history.

(56) References Cited

U.S. PATENT DOCUMENTS

| | | | |
|---|---|---|---|
| 2015/0162119 | A1 | 6/2015 | Nakatsu et al. |
| 2016/0322150 | A1 | 11/2016 | Inaba et al. |
| 2018/0211758 | A1 | 7/2018 | Shitama et al. |

* cited by examiner

REACTOR

CROSS-REFERENCE TO RELATED APPLICATIONS

This application is the U.S. national stage of PCT/JP2018/017763 filed on May 8, 2018, which claims priority of Japanese Patent Application No. JP 2017-106035 filed on May 29, 2017, the contents of which are incorporated herein.

TECHNICAL FIELD

The present disclosure relates to a reactor.

BACKGROUND

JP 2015-122484A discloses a reactor that includes: a coil that includes a coil body constituted by a flat wire with a self-fusing layer; a ring-shaped core; and a coil-side resin member and a core-side resin member. The aforementioned coil-side resin member includes: an end surface plate that covers an end surface of a winding portion of the coil body, and is bonded to the end surface by the self-fusing layer; and a bracket that protrudes from the end surface plate and constitutes a fixing piece to be fixed to a target to which the reactor is to be installed. The aforementioned core is constituted by a leg portion (an inner core portion) that is positioned inside the winding portion, and a pair of C-shaped yoke portions that include a portion (an outer core portion) that is positioned outside the winding portion. The aforementioned core-side resin member is formed by integrating a portion in which each yoke portion is embedded and a tubular bobbin that houses the aforementioned leg portion into one piece. The aforementioned end surface plate is interposed between the end surface of the winding portion and the inner end surface of the yoke portion.

The aforementioned flat wire is, typically, an insulation-coated wire in which a conductive wire that is made of copper is covered with an enamel layer. The self-fusing layer is provided on the outer circumferential surface of an insulation coating such as an enamel layer.

In the case of a reactor that includes a coil with a self-fusing layer as a constituent element, and in which an end surface of a winding portion of the coil and a coil-side resin member are bonded to each other by a self-fusing layer as described above, there is a problem in which the end surface of the aforementioned winding portion may be damaged when the reactor is used. In particular, the enamel layer of the flat wire, which constitutes the end surface of the aforementioned winding portion, may be damaged as described below.

During the use of the aforementioned reactor, a temperature rise and a temperature drop occur one after the other according to energization and de-energization of the coil. If the winding portion and the coil-side resin member thermally contract as a result of a temperature drop, the winding portion and the coil-side resin member deform so as to move away from each other due to the difference between their thermal expansion coefficients and the influence of temperature distribution. An insulation coating such as an enamel layer may be pulled and damaged as a result of such deformation.

Also, due to the aforementioned repetition of a temperature rise and a temperature drop, the self-fusing layer may repeat re-fusing and re-solidification. As a result of a temperature rise, the self-fusing layer re-melts, and the winding portion and the coil-side resin member thermally deform and press against each other. In this state, if the temperature drops to the solidification temperature of the self-fusing layer and the self-fusing layer re-solidifies, the winding portion and the coil-side resin member are re-bonded to each other by the self-fusing layer. After the re-bonding, the winding portion and the coil-side resin member thermally deform, and a state in which the insulation coating is pulled occurs again as described above, which may damage the insulation coating.

Furthermore, during the aforementioned deformation in opposite directions, the pulling force also affects the end surface plate of the coil-side resin member. Therefore, the self-fusing layer repeats re-fusing and re-solidification as described above, the pulling force is repeatedly applied to the end surface plate during the aforementioned deformation, and consequently, cracks may occur in the aforementioned end surface plate.

SUMMARY

One objective of the present disclosure is to provide a reactor in which an end surface of a winding portion is less likely to be damaged even though the reactor is provided with a coil that includes a fusing layer.

A reactor according to the present disclosure includes a coil that includes a winding portion; and a magnetic core that includes an inner core portion that is disposed inside the winding portion and an outer core portion that is disposed outside the winding portion. An outer interposed portion is interposed between an end surface of the winding portion and an inner end surface of the outer core portion, wherein the winding portion includes a winding wire body. A fusing layer is provided on an outer circumferential surface of the winding wire body and joins turns that are adjacent to each other, and the reactor further comprises an adhesion prevention structure configured to prevent the end surface of the winding portion and the outer interposed portion from adhering to each other due to the fusing layer.

Advantageous Effects of the Present Disclosure

In the aforementioned reactor according to the present disclosure, the end surface of the winding portion is less likely to be damaged, even though the reactor is provided with a coil that includes a fusing layer.

DETAILED DESCRIPTION OF PREFERRED EMBODIMENTS

Figure 1:
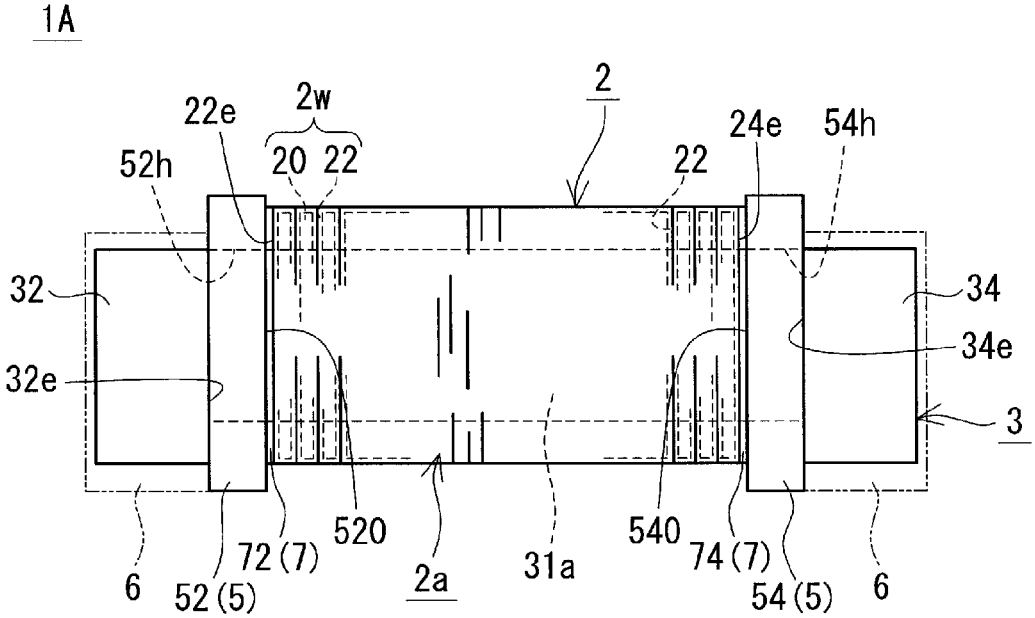
FIG. 1 is a schematic front view showing a reactor according to a first embodiment.

First, embodiments of the present disclosure will be listed and described.

A reactor according to one aspect of the present disclosure includes a coil that includes a winding portion; and a magnetic core that includes an inner core portion that is disposed inside the winding portion and an outer core portion that is disposed outside the winding portion. An outer interposed portion is interposed between an end surface of the winding portion and an inner end surface of the outer core portion, wherein the winding portion includes a winding wire body. A fusing layer is provided on an outer circumferential surface of the winding wire body and joins turns that are adjacent to each other, and the reactor further comprises an adhesion prevention structure configured to prevent the end surface of the winding portion and the outer interposed portion from adhering to each other due to the fusing layer.

The above-described reactor includes a coil that includes a winding portion that has a fusing layer, as a constituent element, and an adhesion prevention structure is provided between an end surface of the winding portion and the outer interposed portion. Therefore, when the above-described reactor is in use, there is substantially no possibility that a force that pulls on the end surface of the winding portion and the outer interposed portion is generated due to the above-described bonding of the fusing layer. Therefore, although the above-described reactor includes a coil that has a fusing layer, as a constituent element, the end surface of the winding portion is less likely to be damaged. In particular, even if the winding wire body that constitutes the end surface of the winding portion is provided with an insulation coating such as an enamel layer, there is substantially no possibility that the insulation coating will be damaged due to the above-described pulling force. Also, in the above-described reactor, there is substantially no possibility that the outer interposed portion will crack due to the above-described pulling force.

In an example of the above-described reactor, the adhesion prevention structure may include an adhesion prevention layer between the end surface of the winding portion and the outer interposed portion. Examples of the constituent material of the adhesion prevention layer include a material that substantially does not adhere to the fusing layer (and that may adhere to the outer interposed portion), a material that substantially does not adhere to the outer interposed portion (and that may adhere to the fusing layer), and a material that substantially does not adhere to neither the fusing layer nor the outer interposed portion.

With the above-described configuration, the adhesion prevention layer is provided between the end surface of the winding portion and the outer interposed portion. Therefore, the fusing layer provided on the end surface of the winding portion does not come into direct contact with the outer interposed portion, and substantially does not adhere thereto. Therefore, with the above-described configuration, although a coil that is provided with a fusing layer is included as a constituent element, the end surface of the winding portion, in particular the insulation coating, and the outer interposed portion are respectively prevented from being damaged or cracking.

In an example of the reactor according to (2) above, the adhesion prevention layer may include a sheet member that is made of a material that substantially does not adhere to the fusing layer.

With the above-described configuration, the above-described specific sheet member is provided, and therefore, there is substantially no possibility that the fusing layer provided on the end surface of the winding portion will adhere to the sheet member or the outer interposed portion. Also, with the above-described configuration, it is easy to manufacture a reactor that is provided with an adhesion prevention structure by disposing the above-described specific sheet member between the end surface of the winding portion and the outer interposed portion in the manufacturing process. Therefore, with the above-described configuration, although a coil that is provided with a fusing layer is included as a constituent element, the end surface of the winding portion and the outer interposed portion are respectively prevented from being damaged or cracking, and productivity is also excellent.

In an example of the reactor according to (3) above, the sheet member may be made of polytetrafluoroethylene (PTFE).

PTFE, which constitutes the above-described sheet member, has excellent heat resistance properties, slipperiness properties, non-adhesiveness properties, low friction properties, insulation properties, and so on, and there is substantially no possibility that PTFE will melt or adhere to the fusing layer when the reactor is used. Therefore, with the above-described configuration, it is possible to keep the end surface of the winding portion and the outer interposed portion in a non-bonded state due to the PTFE sheet member being interposed therebetween, and it is even easier to prevent the end surface of the winding portion and the outer interposed portion from being damaged or cracking, respectively.

In an example of the reactor according to (2) above, the adhesion prevention layer may include an application layer that is made of a material that substantially does not adhere to the fusing layer, and is applied to the outer interposed portion.

With the above-described configuration, it is possible to manufacture a reactor that is provided with an adhesion prevention structure without increasing the number of assembly parts, by forming the application layer on the outer interposed portion in the manufacturing process. Also, it is easier to form the application layer compared to forming the application layer on the end surface of the winding portion. Therefore, with the above-described configuration, although a coil that is provided with a fusing layer is included as a constituent element, the end surface of the winding portion and the outer interposed portion are respectively prevented from being damaged or cracking, and productivity is also excellent in that the number of assembly processes is not increased and the application layer can be easily formed.

In an example of the aforementioned reactor, the adhesion prevention structure may include an exposed end surface at which the end surface of the winding portion does not have the fusing layer, and from which the winding wire body is exposed, and the exposed end surface and the outer interposed portion may be in direct contact with each other.

With the above-described configuration, the fusing layer is not interposed between the end surface of the winding portion and the outer interposed portion. Therefore, there is substantially no possibility that the end surface of the winding portion and the outer interposed portion will be bonded to each other by the fusing layer. Also, with the above-described configuration, for example, it is possible to manufacture a reactor that is provided with an adhesion prevention structure without increasing the number of assembly parts, by forming the exposed end surface by removing the fusing layer that is provided on the end surface of the winding portion, in the manufacturing process. Therefore, with the above-described configuration, although a coil that is provided with a fusing layer is included as a constituent element, the end surface of the winding portion and the outer interposed portion are respectively prevented from being damaged or cracking, and productivity is also excellent in that the number of assembly processes is not increased.

The following specifically describes embodiments of the present disclosure with reference to the drawings. The same reference numerals in the drawings indicate objects with the same names.

First Embodiment

Figure 2:
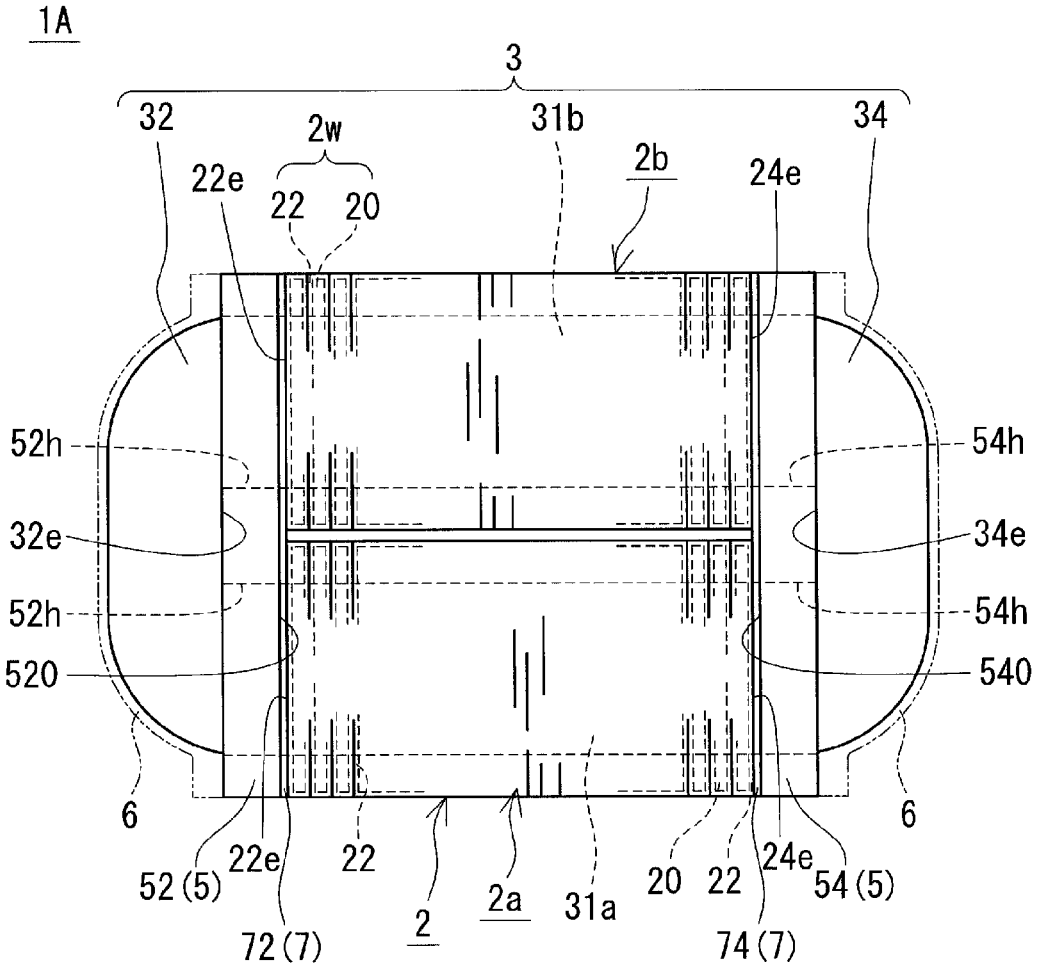
FIG. 2 is a schematic top view showing the reactor according to the first embodiment.

The following describes a reactor 1A according to a first embodiment mainly with reference to FIGS. 1 and 2.

Figure 3:
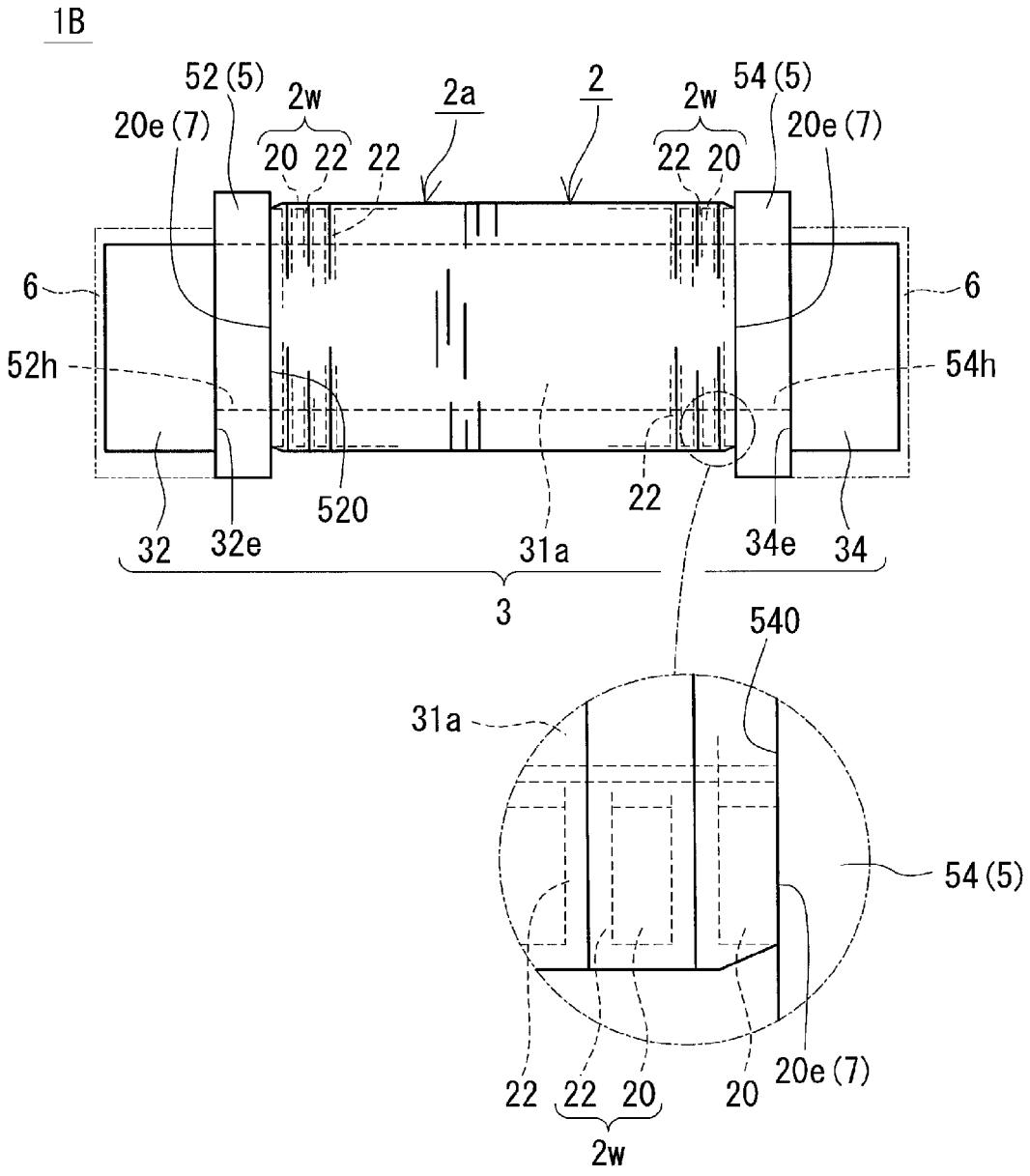
FIG. 3 is a schematic front view showing a reactor according to a second embodiment.

FIG. 1 is a front view of the reactor 1A seen in a direction that is orthogonal to the axial direction of a coil 2 (the left-right direction in FIG. 1) (seen in a direction that is orthogonal to the sheet of FIG. 1 in this example). FIG. 3 described below is also a front view of a reactor 1B according to a second embodiment seen in the same manner as in FIG. 1.

FIG. 2 is a top view of the reactor 1A seen in a direction that is orthogonal to both the axial direction of the coil 2 (the left-right direction in FIG. 2) and the direction in which two winding portions 2*a* and 2*b* are arranged (the top-bottom direction in FIG. 2) (seen in a direction that is orthogonal to the sheet of FIG. 2 in this example).

In FIGS. 1, 2, and 3 described below, for the sake of clarity, an end portion of a winding wire 2*w* that constitutes the coil 2 is omitted, and the overall configurations of the reactors 1A and 1B are schematically shown. Also, a winding wire body 20 and a fusing layer 22 are emphasized for the sake of clarity, and the thicknesses thereof and so on are not to scale.

In the following description, the lower side of the sheets of FIGS. 1 and 3 is regarded as the installation side of the reactors 1A and 1B. This installation direction is an example, and may be changed as appropriate.

Reactor

Overview

The reactor 1A according to the first embodiment includes a coil 2 that includes winding portions, a magnetic core 3 that is arranged inside and outside the winding portions, and an interposed member 5 that is interposed between the coil 2 and the magnetic core 3. In this example, the coil 2 includes a pair of winding portions 2*a* and 2*b* as shown in FIG. 2. The winding portions 2*a* and 2*b* are arranged side by side such that the axes thereof are parallel with each other. The magnetic core 3 includes inner core portions 31*a* and 31*b* that are respectively arranged inside the winding portions 2*a* and 2*b*, and two outer core portions 32 and 34 that are arranged outside the winding portions 2*a* and 2*b*. The two outer core portions 32 and 34 are arranged so as to sandwich the inner core portions 31*a* and 31*b* that are arranged side by side, and thus the magnetic core 3 constitutes a ring-shaped closed magnetic path. The interposed member 5 includes outer interposed portions 52 and 54 that are interposed between one end surface 22*e* of the winding portions 2*a* and 2*b* and an inner end surface 32*e* of one outer core portion 32, and between the other end surface 24*e* of the winding portions 2*a* and 2*b* and an inner end surface 34*e* of the other outer core portion 34. Typically, the reactor 1A is used in the state of being attached to an installation target such as a converter case (not shown).

In the reactor 1A according to the first embodiment, the winding portions 2*a* and 2*b* each include a winding wire body 20 and a fusing layer 22 that is provided on the outer circumferential surface of the winding wire body 20 and joins turns that are adjacent to each other. Also, the reactor 1A according to the first embodiment includes an adhesion prevention structure 7 that prevents the end surface 22*e* of the winding portions 2*a* and 2*b* and the outer interposed portion 52 from adhering to each other due to the fusing layer 22, and the end surface 24*e* of the winding portions 2*a* and 2*b* and the outer interposed portion 54 from adhering to each other due to the fusing layer 22. The reactor 1A in this example includes, as the adhesion prevention structure 7, adhesion prevention layers 72 and 74 between the end surface 22*e* of the winding portions 2*a* and 2*b* and the outer interposed portion 52, and between the end surface 24*e* of the winding portions 2*a* and 2*b* and the outer interposed portion 54, respectively.

The following describes each element in detail.

Coil

The coil 2 included in the reactor 1A according to the first embodiment is a so-called self-fusing type coil. Typically, the coil 2 is formed by spirally winding the winding wire 2*w* that includes the winding wire body 20 and the fusing layer 22 that covers the outer circumferential surface of the winding wire body 20 into a tubular shape, heating the winding wire 2*w* to a predetermined temperature to melt the fusing layer 22, and solidifying the fusing layer 22. Through the aforementioned fusing and solidification, the turns that are adjacent to each other, of a plurality of turns that constitute the winding portions 2*a* and 2*b*, are joined by the fusing layer 22. As the coil 2 is formed from the aforementioned winding wire 2*w*, the fusing layer 22 is present on the inner circumferential surfaces and the outer circumferential surfaces of the winding portions 2*a* and 2*b* and the end surfaces 22*e* and 24*e* (see the dotted lines in FIGS. 1 and 2 and the dotted lines in the enlarged view in the dashed-dotted circle in FIG. 3 described below), in addition to between turns, except for cases in which the fusing layer 22 is removed as in the second embodiment described below. That is to say, there is substantially no area where the winding wire body 20 is exposed from the winding portions 2*a* and 2*b*, and the fusing layer 22 is present on the entire surfaces of the winding portions 2*a* and 2*b*.

The winding wire body 20 is an insulation-coated wire that includes a conductive wire that is made of copper or the like, and an insulation coating that covers the outer circumferential surface of the conductive wire. The constituent material of the insulation coating is, for example, a resin such as polyamideimide, and is typically enamel. The winding wire body 20 in this example is a coated flat wire.

The fusing layer 22 is made of a resin that can be thermally fused. For example, a thermosetting resin such as epoxy resin, silicone resin, or unsaturated polyester may be used. The thickness of the fusing layer 22 may be freely selected within the range in which turns that are adjacent to each other can be joined, and may be thin.

The coil 2 that includes the winding portions 2*a* and 2*b* arranged side by side as described above may have any of the following configurations, for example.

(a) A configuration in which the coil 2 includes the tubular winding portions 2*a* and 2*b* that are formed by spirally winding a single continuous winding wire 2*w*, and a coupling portion (not shown) that is constituted by a portion of the winding wire 2*w* and couples ends of the winding portions 2*a* and 2*b* to each other.

(B) A configuration in which the coil 2 includes the winding portions 2*a* and 2*b* that are individually formed from two independent winding wires 2*w*, and a joint portion that joins ends of the two winding wires 2*w* through welding, crimping, or the like.

The opposite ends of the winding portions 2*a* and 2*b* are used as connection points to which an external device such as a power supply is to be connected.

In addition, the winding portions 2*a* and 2*b* in this example are tubular edgewise coils, and are the same in terms of shape, winding direction, and the number of turns. The dimensions (width and thickness) of the winding wire 2*w*, and the shape, dimensions, the number of turns, and so on of the winding portions 2*a* and 2*b* can be selected as appropriate. It is easy to increase the space factor of the edgewise coils. Therefore, a small coil 2 can be realized. Also, surfaces that face each other at each turn of the edgewise coils have a size corresponding to the width of the winding wire 2*w*. Therefore, it is easy to secure a large joint area of turns that are adjacent to each other, and it is possible to firmly join turns that are adjacent to each other, using the fusing layer 22. In a state in which the adhesion prevention layers 72 and 74 described below are not arranged, the end surfaces 22*e* and 24*e* of the winding portions 2*a* and 2*b* and coil-side surfaces 520 and 540 (described below) of the outer interposed portions 52 and 54 can be in surface contact with each other.

Also, even if the coil 2 includes a resin mold portion 6 described below, the entire outer circumferential surfaces of the winding portions 2*a* and 2*b* in this example are exposed without being covered with the resin mold portion 6. Therefore, heat from the winding portions 2*a* and 2*b* can be dissipated to the installation target of the reactor 1A, which realizes excellent heat dissipation properties.

In the manufacturing process, the aforementioned fusing and solidification can be timely performed after the winding portions 2*a* and 2*b* have been formed. Conditions for thermal processing, such as the heating temperature, can be adjusted as appropriate according to the constituent material of the fusing layer 22.

Magnetic Core

The magnetic core 3 in this example includes two columnar inner core portions 31*a* and 31*b* and two columnar outer core portions 32 and 34 as described above.

Both of the inner core portions 31*a* and 31*b* in this example are rectangular parallelepiped assemblies in each of which a plurality of rectangular parallelepiped core pieces (not shown) and at least one gap member (not shown) are combined one after the other, and have the same shape and the same size. Each of these assemblies may be integrated into one piece using an adhesive, or integrated into one piece using the resin mold portion 6 described below. Also, it is possible to omit the gap member, or employ an air gap. The end surfaces of the inner core portions 31*a* and 31*b* are connected to the inner end surfaces 32*e* and 34*e* of the outer core portions 32 and 34.

The outer core portions 32 and 34 in this example are each constituted by a single columnar core piece, and have the same shape and the same size. The flat shape of the outer core portions 32 and 34 shown in FIG. 2 is an example, and may be modified as appropriate. Also, as shown in FIG. 1, in the outer core portions 32 and 34 in this example, the installation-side surfaces thereof (the lower surfaces in FIG. 1) protrude past the installation-side surfaces (the same as above) of the inner core portions 31*a* and 31*b*. Therefore, it is possible to expand the magnetic paths of the outer core portions 32 and 34, and it is easier to shorten the length of the reactor 1A in the axial direction of the winding portions 2*a* and 2*b* (the axial direction of the inner core portions 31*a* and 31*b*). It is possible to realize a small reactor 1A from this point of view. On the other hand, with the above-described protrusions, areas that face the end surfaces 22*e* and 24*e* of the winding portions 2*a* and 2*b*, of the inner end surfaces 32*e* and 34*e* of the outer core portions 32 and 34 are increased. Therefore, it is desirable to improve insulation between the inner end surfaces 32*e* and 34*e* of the outer core portions 32 and 34 and the end surfaces 22*e* and 24*e* of the winding portions 2*a* and 2*b*. Therefore, in the reactor 1A, the outer interposed portions 52 and 54 that are made of an insulating material are interposed between the inner end surfaces 32*e* and 34*e* of the outer core portions 32 and 34 and the end surfaces 22*e* and 24*e* of the winding portions 2*a* and 2*b*.

Examples of the above-described core pieces include a molded member that is mainly made of a soft magnetic material. Examples of the soft magnetic material include a metal such as iron and an iron alloy (an Fe—Si alloy, an Fe—Ni alloy, or the like), and a nonmetal such as ferrite. Examples of the aforementioned molded member include a powder compact formed through compression molding of powder of a soft magnetic material or a coating powder that additionally contains insulation coating, a molded member of a composite material that contains soft magnetic powder and resin, a laminated member formed by laminating soft magnetic metal plates such as electromagnetic steel plates, and a sintered member such as a ferrite core. Typical examples of the gap member include a nonmagnetic material such as alumina, and a plate member made of a material having a relative permeability lower than that of the aforementioned core pieces.

Interposed Member

The interposed member 5 is typically made of an insulating material such as resin, and functions as an insulating member between the coil 2 and the magnetic core 3. In addition, the interposed member 5 functions as a positioning member for positioning the inner core portions 31*a* and 31*b* and the outer core portions 32 and 34 relative to the winding portions 2*a* and 2*b*, for example. In particular, in the reactor 1A according to the first embodiment, the interposed member 5 includes the outer interposed portions 52 and 54 interposed between the end surfaces 22*e* and 24*e* of the winding portions 2*a* and 2*b* and the outer core portions 32 and 34. The interposed member 5 in this example also includes inner interposed portions (not shown) interposed between the winding portions 2*a* and 2*b* and the inner core portions 31*a* and 31*b*.

Outer Interposed Portions

The outer interposed portion 52 in this example is a frame-shaped plate member, and two through holes 52*h* into which the inner core portions 31*a* and 31*b* are inserted are provided in parallel with each other in a central area of the outer interposed portion 52 (FIG. 2). The outer interposed portion 54 is a frame-shaped plate member that has almost the same shape and the same size as the aforementioned outer interposed portion 52, and two through holes 54*h* into which the inner core portions 31*a* and 31*b* are inserted are provided in parallel with each other in a central area of the outer interposed portion 54 (the same as above). Surfaces of the plate members that constitute the outer interposed portions 52 and 54 face the end surfaces 22*e* and 24*e* of the winding portions 2*a* and 2*b* (hereinafter, the surfaces may be referred to as coil-side surfaces 520 and 540). The other surfaces of the aforementioned plate members face the inner end surfaces 32*e* and 34*e* of the outer core portions 32 and 34 (hereinafter, the surfaces may be referred to as core-side surfaces).

Each of the coil-side surfaces 520 and 540 of the outer interposed portions 52 and 54 may be provided with a spiral groove or protrusion (not shown) that matches the shape of the end surfaces 22*e* and 24*e* of the winding portions 2*a* and 2*b*. If this is the case, the aforementioned coil-side surfaces 520 and 540 and the end surfaces 22*e* and 24*e* of the winding portions 2*a* and 2*b* can be brought into intimate contact with each other. Therefore, it is easier to shorten the reactor 1A in the axial direction of the winding portions 2*a* and 2*b*, and it is easier to downsize the reactor 1A from this point of view. The reactor 1A according to the first embodiment is provided with the adhesion prevention layers 72 and 74. Therefore, even if intimate contact is realized as described above, the end surfaces 22*e* and 24*e* of the winding portions 2*a* and 2*b* and the coil-side surfaces 520 and 540 of the outer interposed portions 52 and 54 are prevented from adhering to each other. Note that FIGS. 1 to 3 schematically illustrate the end surfaces 22*e* and 24*e* of the winding portions 2*a* and 2*b* as planes that are orthogonal to the axial direction of the winding portions 2*a* and 2*b*.

Inner Interposed Portions

The inner interposed portions may be molded integrally with the outer interposed portions 52 and 54 so as to include tubular portions that house at least portions of the inner core portions 31*a* and 31*b*, for example. Specifically, the inner interposed portions may be relatively short tubular portions that are as half as long as the inner core portions 31*a* and 31*b*, and, at the coil-side surfaces 520 and 540 of the outer interposed portions 52 and 54, protrude from the inner circumferential edges that define the through holes 52*h* and 54*h* toward the winding portions 2*a* and 2*b*. In addition, the inner interposed portions may be members independent of the outer interposed portions 52 and 54, or a pair of hook-shaped members instead of being tubular, or a plurality of rod-shaped members arranged apart from each other. If a portion of the resin mold portion 6 described below is to be filled into gaps between the inner core portions 31*a* and 31*b* and the winding portions 2*a* and 2*b*, the areas of the inner interposed portions covered with the inner core portions 31*a* and 31*b* may be reduced, or the inner interposed portions may be omitted. In these cases, it is also possible to improve insulation between the winding portions 2*a* and 2*b* and the inner core portions 31*a* and 31*b* due to the resin mold portion 6 being interposed therebetween.

Constituent Materials

Examples of the constituent material of the interposed member 5 include an insulating material such as resin. Specifically, examples of the resin include a thermoplastic resin, such as a polyphenylene sulfide (PPS) resin, a PTFE resin, a liquid crystal polymer (LCP), a polyamide (PA) resin such as nylon 6 or nylon 66, a polybutylene terephthalate (PBT) resin, and an acrylonitrile butadiene styrene (ABS) resin. Alternatively, thermosetting resin such as an unsaturated polyester resin, an epoxy resin, a urethane resin, or a silicone resin may be used. The interposed member 5 can be manufactured using a well-known molding method such as injection molding.

Adhesion Prevention Structure

The reactor 1A according to the first embodiment includes the adhesion prevention structure 7 that prevents the end surfaces 22*e* and 24*e* of the winding portions 2*a* and 2*b* and the coil-side surfaces 520 and 540 of the outer interposed portions 52 and 54, which face each other as described above, from adhering to each other due to the fusing layer 22 of the coil 2.

Specifically, the adhesion prevention structure 7 may have a configuration in which the adhesion prevention layers 72 and 74 are provided between the end surfaces 22*e* and 24*e* of the winding portions 2*a* and 2*b* and the coil-side surfaces 520 and 540 of the outer interposed portions 52 and 54 as in this example, or a configuration in which end surfaces of the winding portions 2*a* and 2*b* are not provided with the fusing layer 22 and are provided with exposed end surfaces 20*e* as in the second embodiment (FIG. 3), for example.

The following describes the adhesion prevention layers 72 and 74 in detail.

Adhesion Prevention Layers

Sheet Member

The adhesion prevention layers 72 and 74 may include sheet members, for example. With this configuration, it is easier to manufacture the reactor 1A provided with the adhesion prevention structure 7 by arranging the aforementioned sheet members between the end surfaces 22*e* and 24*e* of the winding portions 2*a* and 2*b* and the outer interposed portions 52 and 54 in the manufacturing process.

Examples of the constituent material of the aforementioned sheet members are shown below.

(A) A material that substantially does not adhere to the fusing layer 22 (may adhere to the outer interposed portions 52 and 54).

(B) A material that substantially does not adhere to the outer interposed portions 52 and 54 (may adhere to the fusing layer 22).

(Γ) A material that substantially does not adhere to either the fusing layer 22 nor the outer interposed portions 52 and 54.

More specifically, examples of the material include a resin such as PTFE and insulating paper.

In particular, if a sheet member that is made of a material (A) or (F), which substantially does not adhere to the fusing layer 22, is used, the fusing layer 22 provided on the end surfaces 22*e* and 24*e* of the winding portions 2*a* and 2*b* does not come into direct contact with the outer interposed portions 52 and 54 due to the sheet member being interposed therebetween, and substantially does not adhere to the outer interposed portions 52 and 54. In addition, the fusing layer 22 substantially does not adhere to the sheet member. Examples of such a sheet member include those made of PTFE. PTFE has excellent heat resistance properties, slipperiness properties, non-adhesiveness properties, low friction properties, insulation properties, and so on, and there is substantially no possibility that PTFE will melt or melt and adhere to the fusing layer 22 when the reactor 1A is used. From this point of view also, a configuration that includes a sheet member that is made of PTFE can be desirably employed as the adhesion prevention layers 72 and 74.

In addition, it is possible to prepare outer interposed portions 52 and 54 that are provided with a sheet member by fixing a sheet member that is made of the aforementioned material (A) to the outer interposed portions 52 and 54, using the adhering force of the sheet member itself, or separately bonding the sheet member thereto using an adhesive or the like, in the manufacturing process. Alternatively, it is possible to prepare a coil 2 in which a sheet material that is made of the aforementioned material (B) is fixed to the end surfaces 22*e* and 24*e* of the winding portions 2*a* and 2*b* using the fusing layer 22. With this configuration, the sheet member is less likely to be displaced relative to the outer interposed portions 52 and 54 or the coil 2, and it is easier to assemble the coil 2, the magnetic core 3, and the interposed member 5. Thus, excellent workability is achieved at the time of assembly.

The thickness of the aforementioned sheet member can be freely selected as long as the end surfaces 22*e* and 24*e* of the winding portions 2*a* and 2*b* and the outer interposed portions 52 and 54 are prevented from adhering to each other due to the fusing layer 22. The aforementioned sheet member can be thin as long as the above-described adhesion can be prevented. For example, the aforementioned thickness is no less than approximately 10 μm and no greater than approximately 300 μm. It is possible to employ a configuration in which the entire sheet member has a uniform thickness, as well as a configuration in which a portion of the sheet member has a different thickness. An example of a sheet member including a portion with a different thickness is a sheet member in which surfaces that face the end surfaces 22*e* and 24*e* of the winding portions 2*a* and 2*b* are spirally inclined surfaces that match the aforementioned end surfaces 22*e* and 24*e*, and surfaces that face the outer interposed portions 52 and 54 are flat surfaces that are orthogonal to the axial direction of the winding portions 2*a* and 2*b*. If the external size of the aforementioned sheet member is greater than the size of the end surfaces 22*e* and 24*e* of the winding portions 2*a* and 2*b* or the size of the coil-side surfaces 520 and 540 of the outer interposed portions 52 and 54, it is possible to more reliably prevent the aforementioned adhesion.

The shape of the above-described sheet member can be freely selected as long as the end surfaces 22*e* and 24*e* of the winding portions 2*a* and 2*b* and the outer interposed portions 52 and 54 are prevented from adhering to each other due to the fusing layer 22. Typically, it is possible to more reliably prevent the aforementioned adhesion by employing a shape that corresponds to the end surfaces 22*e* and 24*e* of the winding portions 2*a* and 2*b* or the coil-side surfaces 520 and 540 of the outer interposed portions 52 and 54. In addition, the sheet member in this example may be provided with through holes that are located at positions corresponding to the through holes 52*h* and 54*h* of the outer interposed portions 52 and 54 and have a size corresponding thereto.

Application Layers

Alternatively, the adhesion prevention layers 72 and 74 may include application layers that are applied to at least one of the end surfaces 22*e* and 24*e* of the winding portions 2*a* and 2*b*; and the coil-side surfaces 520 and 540 of the outer interposed portions 52 and 54, for example. With this configuration, it is easier to manufacture the reactor 1A provided with the adhesion prevention structure 7 without increasing the number of assembly parts, by forming application layers on the end surfaces 22*e* and 24*e* of the winding portions 2*a* and 2*b* or the coil-side surfaces 520 and 540 of the outer interposed portions 52 and 54 in the manufacturing process. Also, with this configuration, there is substantially no possibility that the adhesion prevention layers 72 and 74 will be displaced, and the adhesion prevention structure 7 can be kept the same for a long time.

Examples of the constituent material of the aforementioned application layers are shown below.

(Δ) A material that substantially does not adhere to the fusing layer 22, if the coil-side surfaces 520 and 540 of the outer interposed portions 52 and 54 are to be provided with the application layers (the material preferably comes into intimate contact with the coil-side surfaces 520 and 540).

(E) A material that substantially does not adhere to the outer interposed portions 52 and 54, if the end surfaces 22*e* and 24*e* of the winding portions 2*a* and 2*b* are to be provided with application layers (the material preferably comes into intimate contact with the end surfaces 22*e* and 24*e*).

(Z) A material with which application layers do not adhere to each other, if both the end surfaces 22*e* and 24*e* of the winding portions 2*a* and 2*b* and the coil-side surfaces 520 and 540 of the outer interposed portions 52 and 54 are to be provided with application layers (the application layers on the winding portions 2*a* and 2*b* preferably come into intimate contact with the end surfaces 22*e* and 24*e* and the application layers on the outer interposed portions 52 and 54 preferably come into intimate contact with the coil-side surfaces 520 and 540).

Specific examples of the material include fluorine compounds and silicone compounds.

In particular, if application layers that are made of the material (Δ) that substantially does not adhere to the fusing layer 22 and are applied to the coil-side surfaces 520 and 540 of the outer interposed portions 52 and 54 are included, the fusing layer 22 provided on the end surfaces 22*e* and 24*e* of the winding portions 2*a* and 2*b* does not come into direct contact with the outer interposed portions 52 and 54 due to the aforementioned application layers being interposed therebetween. Also, the aforementioned fusing layer 22 substantially does not adhere to the outer interposed portions 52 and 54, and substantially does not adhere to the aforementioned application layers. Furthermore, it is easier to form application layers in a case in which the application layers are to be formed on the coil-side surfaces 520 and 540 of the outer interposed portions 52 and 54 compared to a case in which the application layers are to be formed on the end surfaces 22*e* and 24*e* of the winding portions 2*a* and 2*b* in the manufacturing process, and productivity is excellent in this respect. Specific examples of the material of such application layers include fluorine compounds and silicone compounds.

The thickness of the aforementioned application layers can be freely selected as long as the end surfaces 22*e* and 24*e* of the winding portions 2*a* and 2*b* and the outer interposed portions 52 and 54 are prevented from adhering to each other due to the fusing layer 22. The aforementioned application layers can be thin as long as the above-described adhesion can be prevented. For example, the aforementioned thickness is no less than approximately 0.1 μm and no greater than approximately 20 μm. The aforementioned application layers more reliably prevent the above-described adhesion when they are formed in correspondence with application targets such as the end surfaces 22*e* and 24*e* of the winding portions 2*a* and 2*b* and the coil-side surfaces 520 and 540 of the outer interposed portions 52 and 54.

Others

Alternatively, the adhesion prevention layers 72 and 74 may be provided with both the above-described sheet member and the above-described application layers, for example. For example, the above-described sheet member may be provided between one end surface 22*e* of the winding portions 2*a* and 2*b* and the outer interposed portion 52, and the above-described application layer may be provided between the other end surface 24*e* of the winding portions 2*a* and 2*b* and the outer interposed portion 54. Alternatively, the above-described sheet member may be provided between a portion of one end surface 22*e* of the winding portions 2*a* and 2*b* and a portion of the outer interposed portion 52, and the above-described application layer may be provided between another portion of one end surface 22*e* of the winding portions 2*a* and 2*b* and another portion of the outer interposed portion 52.

Resin Mold Portion

In addition, the reactor 1A may include the resin mold portion 6 that covers at least a portion of the outer circumferential surface of an assembled body that includes the coil 2, the magnetic core 3, and the interposed member 5. For example, the resin mold portion 6 may include outer resin portions that cover at least portions of the outer circumferential surfaces of the outer core portions 32 and 34, and inner resin portions that are interposed between the winding portions 2*a* and 2*b* and the inner core portions 31*a* and 31*b*. In FIG. 1 and so on, the outer resin portions are virtually indicated by two-dot chain lines, and the inner resin portions are not shown. The outer resin portions and the inner resin portions may be formed as a continuous integrally-molded member, or independent molded members. If the aforementioned integrally-molded member is employed, the shape, size, and so on of the through holes 52*h* and 54*h* of the outer interposed portions 52 and 54 may be adjusted so that the inner resin portions can be formed.

If the inner resin portions and the outer resin portions are formed as the above-described integrally-molded member, and the above-described assembled member is integrated by covering portions of the core-side surfaces of the outer interposed portions 52 and 54 using the outer resin portions, it is easier to improve the rigidity of the aforementioned assembled member as an integrated member. As a result, it is possible to realize a reactor 1A with which noise and vibration can be easily reduced. If the adhesion prevention layers 72 and 74 are not provided and the outer interposed portions 52 and 54 and the magnetic core 3 are integrated by the resin mold portion 6, a force that pulls on the end surfaces 22*e* and 24*e* of the winding portions 2*a* and 2*b* is likely to be generated as described above due to the hot-cold cycle during the use of the reactor 1A. In contrast, the reactor 1A according to the first embodiment is provided with the adhesion prevention layers 72 and 74, and therefore, even if the outer interposed portions 52 and 54 and the magnetic core 3 are integrated by the resin mold portion 6, a force that pulls on the end surfaces 22*e* and 24*e* of the winding portions 2*a* and 2*b* substantially does not occur, and the insulation coating is less likely to be damaged.

In addition, the outer resin portions may be provided with an attachment portion (not shown) for fixing the reactor 1A to the installation target.

Constituent Material

Examples of the constituent resin of the resin mold portion 6 include thermoplastic resins such as a PPS resin, a PTFE resin, LCP, a PA resin such as nylon 6, nylon 66, nylon 10T, nylon 9T, or nylon 6T, and a PBT resin. If such a resin contains a filler or the like with excellent thermal conductivity, a resin mold portion 6 with excellent heat dissipation properties can be realized. Injection molding or the like may be employed to mold the resin mold portion 6.

Method for Manufacturing Reactor

Basically, the reactor 1A according to the first embodiment can be manufactured by attaching the coil 2, the magnetic core 3, and the interposed member 5 to each other.

In particular, if sheet members are to be included in the adhesion prevention layers 72 and 74, sheet members are also attached between the end surfaces 22*e* and 24*e* of the winding portions 2*a* and 2*b* and the coil-side surfaces 520 and 540 of the outer interposed portions 52 and 54 in the above-described attachment process. Typically, the fusing layer 22 is melted and solidified before the sheet members are attached.

Alternatively, in particular, if application layers are to be included in the adhesion prevention layers 72 and 74, a coil 2 and an interposed member 5 provided with the application layers are prepared by forming the application layers on the end surfaces 22*e* and 24*e* of the winding portions 2*a* and 2*b* and the coil-side surfaces 520 and 540 of the outer interposed portions 52 and 54, and the coil 2, the magnetic core 3, and the interposed member 5 are attached to each other. If application layers are to be formed on the end surfaces 22*e* and 24*e* of the winding portions 2*a* and 2*b*, the fusing layer 22 is typically melted and solidified before the application layers are formed. If application layers are to be formed on the coil-side surfaces 520 and 540 of the outer interposed portions 52 and 54, the fusing layer 22 may be timely melted and solidified.

If the resin mold portion 6 is to be included, an assembled member that has been assembled in the above-described manner may be housed in a resin mold, and the resin mold portion 6 may be molded so as to cover a predetermined portion of the aforementioned assembled member.

Usage

The reactor 1A according to the first embodiment can be used as a component of a circuit that performs voltage step-up and step-down operations, such as a constituent component of various converters and power conversion devices. Examples of the converters include an on-board converter (typically a DC-DC converter) installed in a vehicle such as a hybrid vehicle, a plug-in hybrid vehicle, an electric vehicle, or a fuel cell vehicle, and a converter for an air conditioner.

Advantageous Effects

The reactor 1A according to the first embodiment includes the coil 2 provided with the fusing layer 22, as a constituent element, and the adhesion prevention structure 7 is provided between the end surfaces 22*e* and 24*e* of the winding portions 2*a* and 2*b* and the outer interposed portions 52 and 54. Therefore, when the reactor 1A is used, there is substantially no possibility that the end surfaces 22*e* and 24*e* of the winding portions 2*a* and 2*b* and the outer interposed portions 52 and 54 will be bonded to each other by the fusing layer 22 on the end surfaces 22*e* and 24*e* of the winding portions 2*a* and 2*b*. Therefore, although the reactor 1A includes the coil 2 provided with the fusing layer 22 as a constituent element, there is substantially no possibility that the end surfaces 22*e* and 24*e* of the winding portions 2*a* and 2*b*, in particular the insulation coating of the winding wire body 20 that constitutes the end surfaces 22*e* and 24*e*, will be damaged due to the above-described bonding. Also, there is substantially no possibility that the outer interposed portions 52 and 54 will break due to the above-described bonding.

The reactor 1A in this example includes, as the adhesion prevention structure 7, the adhesion prevention layers 72 and 74 interposed between the end surfaces 22*e* and 24*e* of the winding portions 2*a* and 2*b* and the coil-side surfaces 520 and 540 of the outer interposed portions 52 and 54, thereby further achieving the following advantageous effects.

The fusing layer 22 provided on the end surfaces 22*e* and 24*e* of the winding portions 2*a* and 2*b* substantially do not adhere to the outer interposed portions 52 and 54, and therefore, it is easier to prevent the end surfaces 22*e* and 24*e* of the above-described winding portions 2*a* and 2*b*, in particular, the insulation coating, from being damaged.

(2) If the adhesion prevention layers 72 and 74 include the above-described sheet members, the aforementioned sheet members may be interposed between the end surfaces 22*e* and 24*e* of the winding portions 2*a* and 2*b* and the coil-side surfaces 520 and 540 of the outer interposed portions 52 and 54 in the manufacturing process, and productivity is excellent because such a reactor 1A can be easily manufactured.

(3) If the adhesion prevention layers 72 and 74 include the above-described application layers, productivity is excellent because it is possible to manufacture the reactor 1A provided with the adhesion prevention structure 7 without increasing the number of assembly parts.

In addition, the reactor 1A according to the first embodiment may include at least one of the following. The same applies to the second embodiment and the modification described below.

(a) Sensors (not shown) that measure physical quantities regarding the reactor 1A, such as a temperature sensor, a current sensor, a voltage sensor, and a magnetic flux sensor.

(b) A heat dissipation plate (e.g. a metal plate) that is attached to at least a portion of the outer circumferential surface of the coil 2.

(c) A bonding layer (e.g. an adhesive layer, preferably with excellent insulation properties) that is interposed between the installation surface of the reactor 1A and the installation target or the heat dissipation plate in (b).

Second Embodiment

The following describes a reactor 1B according to a second embodiment with reference to FIG. 3.

The reactor 1B according to the second embodiment has the same basic configuration as the reactor 1A according to the first embodiment, and includes the coil 2 provided with the fusing layer 22, the magnetic core 3, the interposed member 5 including the outer interposed portions 52 and 54, and the resin mold portion 6 if necessary. Also, as with the reactor 1A according to the first embodiment, the reactor 1B includes the adhesion prevention structure 7 that prevents the end surfaces of the winding portions 2*a* and 2*b* and the outer interposed portions 52 and 54 from adhering to each other due to the fusing layer 22. The reactor 1B is different from the first embodiment in that the reactor 1B is not provided with the adhesion prevention layers 72 and 74 as the adhesion prevention structure 7. In the reactor 1B, the end surfaces of the winding portions 2*a* and 2*b* do not have the fusing layer 22 as the adhesion prevention structure 7, but have exposed end surfaces 20*e* from which the winding wire body 20 is exposed, and the exposed end surfaces 20*e* and the coil-side surfaces 520 and 540 of the outer interposed portions 52 and 54 are in direct contact with each other.

The following describes the details of this difference, and detailed descriptions of redundant components and effects are omitted.

As in the first embodiment, the coil 2 included in the reactor 1B according to the second embodiment is a so-called self-fusing type coil in which turns that are adjacent to each other are joined to each other by the fusing layer 22. In this coil 2, the fusing layer 22 is present on the inner circumferential surfaces and the outer circumferential surfaces of the winding portions 2*a* and 2*b* in addition to between turns (see the broken lines in FIG. 3). However, the fusing layer 22 is removed from the end surfaces of the winding portions 2*a* and 2*b*, and the winding wire body 20 is exposed (see the enlarged view in the dashed-dotted circle shown in FIG. 3).

The coil 2 in which some portions are not provided with the fusing layer 22 as described above is formed in the following manner, for example. As described in the first embodiment, after the winding wire 2*w* in which the outer circumferential surface of the winding wire body 20 is covered with the fusing layer 22 is spirally wound, fusing and solidification are performed, and thus a coil in which the fusing layer 22 is present on the entire surfaces of the winding portions 2*a* and 2*b* is manufactured. From this coil, the fusing layer 22 on the end surfaces of the winding portions 2*a* and 2*b* is removed, so that the winding wire body 20 is exposed. Thus, the coil 2 provided with the exposed end surfaces 20*e* can be obtained. To remove the fusing layer 22, an appropriate solvent that can remove the fusing layer 22 and substantially does not dissolve the insulation coating may be used. Alternatively, the fusing layer 22 may be ground away. When the aforementioned solvent is to be used, it is possible to reliably remove only a desired portion of the fusing layer 22 by masking a portion that is not to be removed, in the vicinity of a portion that is to be removed, of the fusing layer 22. Furthermore, regarding the winding wire 2*w* that constitutes turns in the vicinity of the exposed end surfaces 20*e*, the fusing layer 22 provided on the inner circumferential surfaces and the outer circumferential surfaces of the winding portions 2*a* and 2*b* may be removed, or partially made thinner. The enlarged view in the dashed-dotted circle in FIG. 3 illustrates a configuration in which the fusing layer 22 provided on the outer circumferential surfaces of the winding portions 2*a* and 2*b* is continuously made thinner in the vicinity of the exposed end surfaces 20*e*, in a direction toward the exposed end surfaces 20*e*. In this configuration, an inclined surface is present in the vicinity of the above-described exposed end surface 20*e*, where the thickness of the fusing layer 22 continuously decreases in a direction toward the exposed end surface 20*e*. It is possible to employ a configuration that is provided with a step surface where the aforementioned thickness decreases step by step is employed instead of the inclined surface. As described above, by adjusting the thickness of the fusing layer 22 in the vicinity of the exposed end surfaces 20*e*, it is easier to prevent the fusing layer 22 on the inner circumferential surfaces and the outer circumferential surfaces of the winding portions 2*a* and 2*b* from being melted and leaking to gaps between the exposed end surfaces 20*e* and the outer interposed portions 52 and 54 during the use of the reactor 1B. Note that the coating layer that constitutes the fusing layer 22 may be partially removed before fusing and solidification are performed.

The reactor 1B according to the second embodiment can be manufactured by preparing the coil 2 provided with the exposed end surfaces 20*e* as described above, the magnetic core 3, and the interposed member 5, and attaching them to each other, for example. If the resin mold portion 6 is to be included, the resin mold portion 6 may be molded so as to cover a predetermined portion of the assembled member.

As in the first embodiment, the reactor 1B according to the second embodiment includes the coil 2 provided with the fusing layer 22, as a constituent element. However, the adhesion prevention structure 7 is provided between the end surfaces of the winding portions 2*a* and 2*b* and the outer interposed portions 52 and 54. Therefore, in the reactor 1B according to the second embodiment, as in the first embodiment, the end surfaces of the winding portions 2*a* and 2*b*, in particular the insulation coating, and the outer interposed portions 52 and 54 can be respectively prevented from being damaged or cracking due to the adhesion of the fusing layer 22.

In particular, the reactor 1B according to the second embodiment employs a configuration in which the fusing layer 22 is not interposed between the end surfaces of the winding portions 2*a* and 2*b* and the outer interposed portions 52 and 54 as the adhesion prevention structure 7. Therefore, in the reactor 1B, there is substantially no possibility that the end surfaces of the winding portions 2*a* and 2*b* and the outer interposed portions 52 and 54 will be bonded to each other by the fusing layer 22. In such a reactor 1B, the end surfaces of the winding portions 2*a* and 2*b* and the outer interposed portions 52 and 54 can be kept in a proper state for a long time. Also, the reactor 1B is excellent in terms of productivity in the respect that the reactor 1B that includes the adhesion prevention structure 7 can be manufactured by attaching the coil 2 that is provided with the exposed end surfaces 20*e* as described above, without increasing the number of components that are to be attached, or the number of assembly processes.

The present disclosure is not limited to these examples. The present disclosure is defined by the claims, and all modifications equivalent to and within the scope of the claims are intended to be encompassed. For example, at least one of the following changes be applied to the above-described first and second embodiments (modifications).

(A) A combination of the first embodiment and the second embodiment is employed. Specifically, the end surfaces 22*e* and 24*e* of the winding portions 2*a* and 2*b* are formed as the exposed end surfaces 20*e* described in the second embodiment, and the adhesion prevention layers 72 and 74 described in the first embodiment are provided between the exposed end surfaces 20*e* and the outer interposed portions 52 and 54. If this is the case, even if the fusing layer 22 other than that on the end surfaces 22*e* and 24*e*, such as that on the inner circumferential surface and the outer circumferential surface of the coil 2, repeats re-fusing and re-solidification and wraps around the exposed end surfaces 20*e*, the end surfaces 22*e* and 24*e* of the winding portions 2*a* and 2*b* and the outer interposed portions 52 and 54 can be more reliably prevented from adhering to each other for a long time due to the adhesion prevention layers 72 and 74 being interposed therebetween.

(B) A coated round wire including a round conductor wire and an insulation coating, for example, is employed as the winding wire 2*w* constituting the coil 2.

(C) The coil 2 includes only one winding portion, and the magnetic core 3 includes a middle magnetic leg portion in which the winding portion is disposed, two side magnetic leg portions that are parallel with the middle magnetic leg portion, and a pair of plate-shaped coupling portions that sandwich the three magnetic leg portions that are parallel with each other. Examples of such a magnetic core 3 include those called an EI-type core, an EE type core, an ER type core, and so on.

The invention claimed is:

1. A reactor comprising:

a coil that includes a winding portion;

a magnetic core that includes an inner core portion that is disposed inside the winding portion and an outer core portion that is disposed outside the winding portion; and an outer interposed portion that is interposed between an end surface of the winding portion and an inner end surface of the outer core portion, wherein the winding portion includes a winding wire body and a fusing layer that is provided on an outer circumferential surface of the winding wire body and joins turns that are adjacent to each other, and the reactor further comprises an adhesion prevention structure configured to prevent the end surface of the winding portion and the outer interposed portion from adhering to each other due to the fusing layer.

2. The reactor according to claim 1, wherein the adhesion prevention structure includes an adhesion prevention layer between the end surface of the winding portion and the outer interposed portion.

3. The reactor according to claim 2, wherein the adhesion prevention layer includes a sheet member that is made of a material that substantially does not adhere to the fusing layer.

4. The reactor according to claim 3, wherein the sheet member is made of polytetrafluoroethylene.

5. The reactor according to claim 2, wherein the adhesion prevention layer includes an application layer that is made of a material that substantially does not adhere to the fusing layer, and is applied to the outer interposed portion.

6. The reactor according to claim 1, wherein the adhesion prevention structure includes an exposed end surface at which the end surface of the winding portion does not have the fusing layer, and from which the winding wire body is exposed, and the exposed end surface and the outer interposed portion are in direct contact with each other.

* * * * *